US006609599B1

(12) United States Patent
Chang

(10) Patent No.: US 6,609,599 B1
(45) Date of Patent: Aug. 26, 2003

(54) EXTENSIBLE HANDLE SYSTEM FOR CARRYING CONTAINER

(76) Inventor: John Nia You Chang, 869 Country Rd., Monterey Park, CA (US) 91755

( * ) Notice: Subject to any disclaimer, the term of this patent is extended or adjusted under 35 U.S.C. 154(b) by 0 days.

(21) Appl. No.: 10/178,098

(22) Filed: Jun. 25, 2002

(51) Int. Cl.[7] ..... A45C 13/28

(52) U.S. Cl. ..... 190/115; 190/39; 190/102; 16/113.1

(58) Field of Search ..... 190/39, 102, 115; 16/113.1; 224/148.4

(56) References Cited

U.S. PATENT DOCUMENTS

| | | | | | |
|---|---|---|---|---|---|
| 2,413,830 | A | * | 1/1947 | Janosz | 190/115 |
| 5,839,738 | A | * | 11/1998 | Ozark | 280/30 |
| 5,924,169 | A | * | 7/1999 | Lu | 190/115 X |
| 6,067,816 | A | * | 5/2000 | Hodosh | 62/457.4 |
| 6,305,514 | B1 | * | 10/2001 | Lin et al. | 190/115 |
| 6,328,146 | B1 | * | 12/2001 | Siwak | 190/109 |
| 6,390,431 | B1 | * | 5/2002 | Ott | 248/311.2 |

FOREIGN PATENT DOCUMENTS

| | | | | |
|---|---|---|---|---|
| DE | 4221215 | * | 1/1994 | 190/102 |

* cited by examiner

*Primary Examiner*—Sue A. Weaver
(74) *Attorney, Agent, or Firm*—Raymond Y. Chan; David and Raymond Patent Group

(57) ABSTRACT

A holding arrangement, which is incorporated with a carrying container, includes a handle seat securely mounted on a top side of a container body. The handle seat has receiving chamber indented thereon to form a first and second longitudinal opposed inner walls and an arch wall integrally extended from the first inner wall to form a holding cavity to communicate with the receiving chamber. The receiving chamber is arranged to receive the gripping handle therein while a side biasing wall of the gripping handle faces towards the arch wall. Therefore, when the bottom portion of the holding object is disposed in the holding cavity, the circumferential surface of the holding object is biased by the arch wall and the side biasing wall of the gripping handle so as to securely hold the holding object on the upper side of the container body.

20 Claims, 5 Drawing Sheets

EXTENSIBLE HANDLE SYSTEM FOR CARRYING CONTAINER

BACKGROUND OF THE PRESENT INVENTION

1. Field of Invention

The present invention relates to a carrying container, and more particularly to an extensible handle system for carrying container, wherein the extensible handle system comprises a holding arrangement incorporated with an extensible handle frame for holding a can of soda, a pen or the like without altering the original structure of the carrying container.

2. Description of Related Arts

Carrying containers are considered as one of the useful tools for traveling. A convention container such as a fabric type carrying baggage or a metal type carrying case has a major drawback. The problem with the conventional carrying container is that they are bulky, usually heavy, and difficult to carry. Therefore, it is preferred for the carrying container to be incorporated with a wheel and an extensible handle frame for carrying the carrying container.

As shown in FIG. 1, an improved carrying container comprises a container body, a pair of wheels rotatably mounted underneath the container body, and an extensible handle frame mounted on a rear side of the container body, in such a manner by upwardly extending the handle frame, the user is able to pivotally lift up the container body about the wheels for carrying the container body.

The handle frame generally comprises a base support received in an interior of the container body and a movable arm, having a handle bar, slidably and upwardly extended from the base support wherein the movable arm is capable of moving between a storage position and an extended position. In which, at the storage position, the movable arm is downwardly slid into the interior of the container body until the handle bar is rested on top of a top panel of the container body, and at the extended position, the movable arm is slid upwardly with respect to the base support until the handle bar is positioned above the top panel of the container body at a predetermined distance.

Even though such carrying container is convenient for the traveler to carry, the mobility of the carrying container may bring problems to the traveler. Most travelers have an experience that when they are waiting in the airport or train station, they would like to put their drinks on the carrying container as a temporary coffee table. Since the travelers think the box-shaped carrying container can well support the drinks stably, the movement of the wheeled structure of the carrying container always causes the drinks fallen off from the carrying container. Moreover, while checking in/out, a stop and go manner always give a hassle for the traveler since they have to take care all their passports, drinks, and carrying container at the same time.

Another drawback of the carrying container is that the attachment between the container body and the handle frame is not strong and rigid enough. Since the carrying container is heavy when it is loaded, a weak attachment may cause the failure support for the container body and even damage the objects inside the container body. Therefore, the conventional carrying container must employ with a secure joint to mount the handle frame with the top panel of the container body so as to reinforce the vertical movement of the movable arm.

SUMMARY OF THE PRESENT INVENTION

A main object of the present invention is to provide an extensible handle system for a carrying container, which comprises a holding arrangement incorporated with an extensible handle frame for holding a can of soda, a pen or the like.

Another object of the present invention is to provide an extensible handle system for a carrying container, wherein the holding arrangement is securely attached to a container body so as to further the rigid connection between the extensible handle system and the container body.

Another object of the present invention is to provide an extensible handle system for a carrying container, wherein the carrying container does not require to alter its original structure in order to incorporate with the holding arrangement, so as to minimize the manufacturing cost of the carrying container with the extensible handle system.

Another object of the present invention is to provide an extensible handle system for a carrying container, wherein no expensive or complicated part is required to employ in the present invention in order to achieve the above mentioned objects. Therefore, the present invention successfully provides an economic and efficient solution for providing a holding arrangement and a reinforced supporting configuration to the carrying container.

Accordingly, in order to achieve the above objects, the present invention provides a carrying container, comprising:

a container body having an upper side and a bottom side;

a wheel assembly mounted on the bottom side of the container body;

an extensible handle system comprising a retractable frame assembly supported between the upper and bottom sides of the container body and a gripping handle slidably connected to the retractable frame assembly in vertically movable manner such that the gripping handle is capable of sliding upwardly above the upper side of the container body at an extending position and is allowed to be retracted to a folded position that the gripping handle is rested on the upper side of the container body; and a holding arrangement, which is adapted for holding a holding object having a circular bottom portion in position, comprising a handle seat securely mounted on the upper side of the container body to retain a vertical movement of the gripping handle wherein the handle seat has receiving chamber indented thereon to form a first and second longitudinal opposed inner walls and an arch wall integrally extended from the first inner wall to form a holding cavity to communicate with the receiving chamber;

wherein the receiving chamber, having a width at least larger than a width of the gripping handle, is arranged to receive the gripping handle therein while a side biasing wall of the gripping handle faces towards the arch wall;

whereby, when the bottom portion of the holding object is disposed in the holding cavity, the arch wall is biased against a circumferential surface portion of the holding object while the side biasing wall of the gripping handle is biased against an opposed circumferential surface portion of the holding object so as to securely hold the holding object on the upper side of the container body.

DETAILED DESCRIPTION OF THE PREFERRED EMBODIMENT

Figure 1:
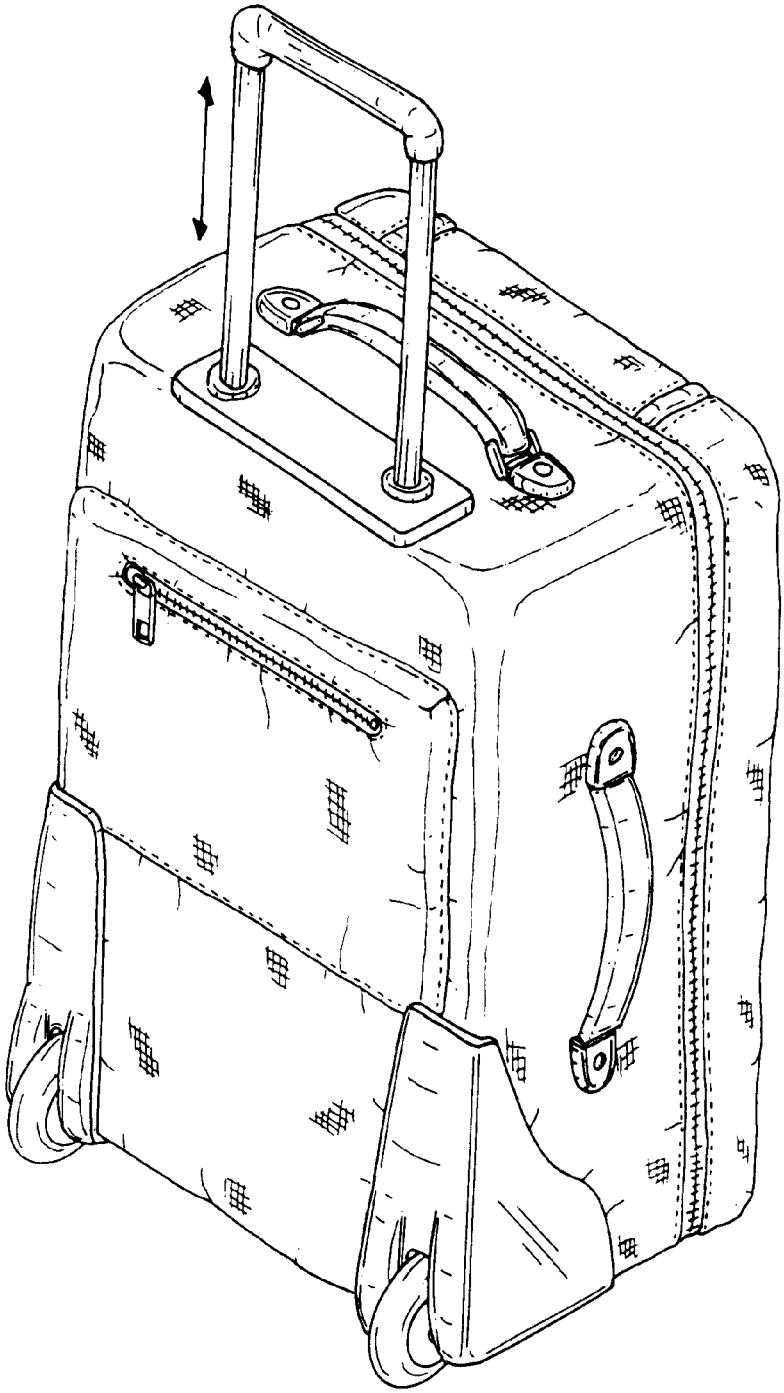
FIG. 1 PRIOR ART
FIG. 1 is a perspective view of a conventional carrying container.
Figure 2:
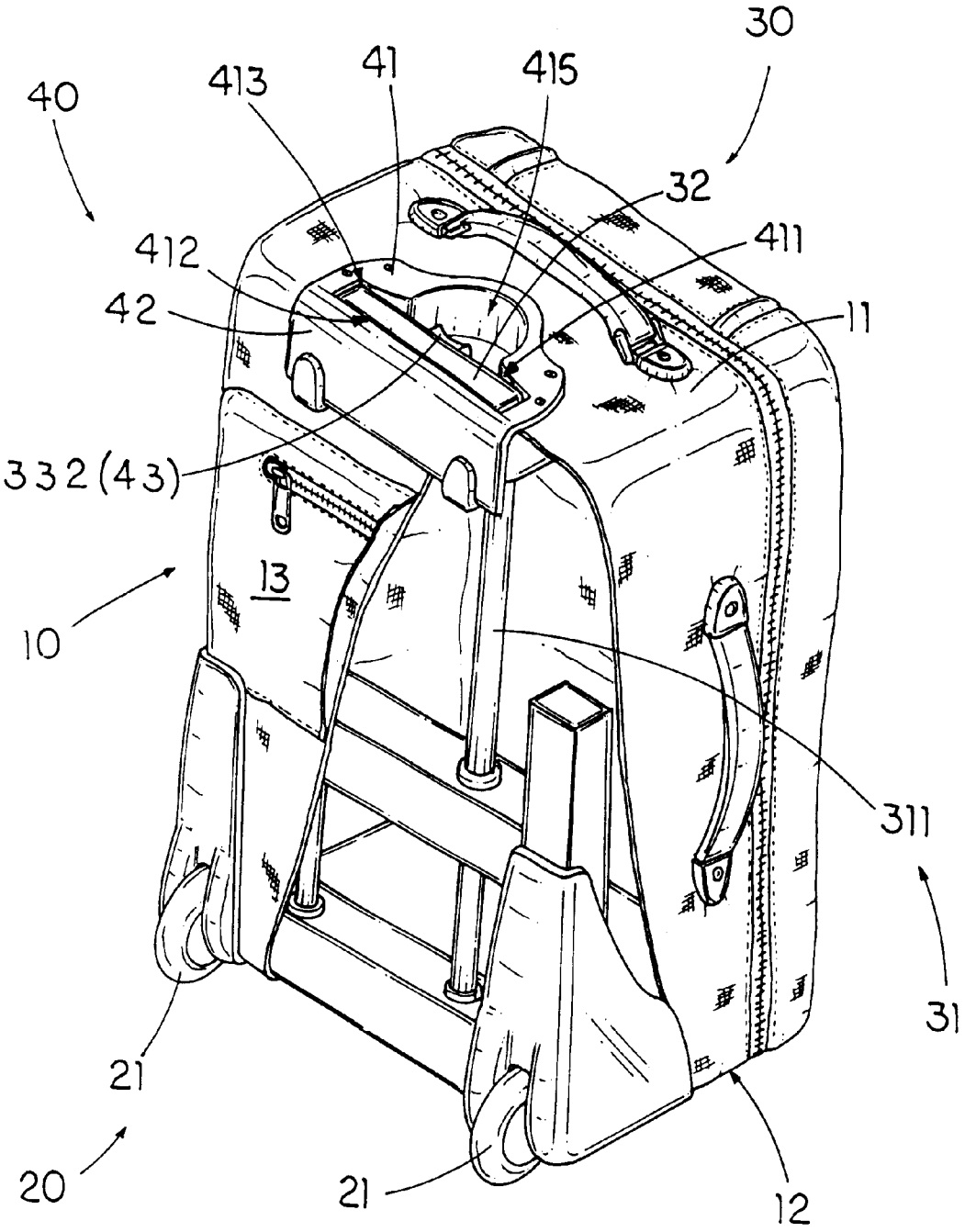
FIG. 2 is a perspective view of a carrying container according to a preferred embodiment of the present invention.

Referring to FIG. 2 of the drawings, a carrying container according to a preferred embodiment of the present invention is illustrated, wherein the carrying container, such as a standard carrying container, comprises a container body 10 having an upper side 11 and a bottom side 12 and a wheel assembly 20 mounted on the bottom side of 12 the container body 10.

The carrying container further comprises an extensible handle system 30 and a holding arrangement 40.

The extensible handle system 30 comprises a retractable handle assembly 31 supported between the upper and bottom sides 11, 12 of the container body 10 and a gripping handle 32 slidably connected to the retractable handle assembly 31 in vertically movable manner such that the gripping handle 32 is capable of sliding upwardly above the upper side 11 of the container body 10 at an extending position and is allowed to be retracted to a folded position that the gripping handle 32 is positioned on the upper side 11 of the container body 10.

The holding arrangement 40, which is adapted for holding a holding object A having a circular bottom portion in position, comprises a handle seat 41 securely mounted on the upper side 11 of the container body 10 to retain a vertical movement of the gripping handle 32 wherein the handle seat 41 has receiving chamber 413 indented thereon to form a first and second longitudinal opposed inner walls 411, 412 and an arch wall 414 integrally extended from the first inner wall 411 to form a holding cavity 415 communicating with the receiving chamber 413.

The receiving chamber 413, having a width at least larger than a width of the gripping handle 32, is arranged to receive the gripping handle 32 therein while a side biasing wall 321 of the gripping handle 32 faces towards the arch wall 414. Therefore, when the bottom portion of the holding object A is disposed in the holding cavity 415, the arch wall 414 is biased against a circumferential surface portion of the holding object A while the side biasing wall 321 of the gripping handle 32 is biased against an opposed circumferential surface portion of the holding object A so as to securely hold the holding object A on the upper side 11 of the container body 10.

According to the preferred embodiment, the container body 10, having a box-shaped, is embodied as a fabric made carrying baggage. Since the container body 10 is made of durable fabric, the container body 10 is capable of adjusting the size of the panels to maximize or minimize a containing volume thereof. It is worth mentioning that the container body 10 can be constructed as a hard cover carrying case that the panels thereof are made of rigid metal.

The wheel assembly 20 comprises two spaced apart supporting wheels 21 rotatably mounted on the bottom side 12 of the container body 10, wherein the supporting wheels 21 are rotatably supported by the extensible handle system 30 so as to ensure the substantial support of the wheel assembly 20 when the container body 10 is transported.

The retractable handle assembly 31 comprises a base support 311 mounted on a back panel of the container body 10 and an extensible arm 312 slidably connected to the base support 311 in a vertically movable manner wherein the gripping handle 32 provided at a top portion of the extensible arm 312 such that the gripping handle 32 is slid to the extending position by upwardly sliding the extensible arm 312 with respect to the base support 311 and is slid to the folded position by downwardly sliding the extensible arm 312 with respect to the base support 311.

As shown in FIG. 2, the base support 311 is securely mounted to an inner side of the back panel of the container wherein the base support 311 has a predetermined length extended from the upper side 11 of the container body 10 to a bottom side 12 thereof, in such a manner that the supporting wheels 21 are rigidly supported at a bottom portion of the base support 311. Moreover, the base support 311 functions as a supporting frame for the container body 10 to reinforce the shape of the container body 10.

Accordingly, the base support 311 is enclosed within the container body 10 so as to keep the aesthetic appearance of the carrying container. However, the base support 311 can also be mounted to an outer side of the back panel of the container 10 such that the extensible handle system 30 is positioned at an exterior of the container body 10.

The holding arrangement 40, according to the preferred embodiment, functions as a cup holder such that the holding object A having the circular bottom portion, such as a can of soda or cup of drink, can be held by the holding arrangement 40 on top of the container body 10.

The handle seat 41 is substantially mounted on the upper side 11 of the container body 10 wherein the receiving chamber 413 is an elongated slot longitudinally provided on the handle seat 41 for the extensible arm 312 slidably passing through. The receiving chamber 413 is shaped and sized to fit the gripping handle 32 receive therein when the extensible arm 312 is slidably folded up.

The holding arrangement 40 further comprises an edge protecting panel 42 integrally extended from the handle seat 41 to attach on a rear side 13 of the container body 10 so as to protect an edge between the upper and rear sides 11, 13 of the container body 10.

The arch wall 414 is integrally extended from a mid-portion of the first inner wall 411 of the receiving chamber 413 in such a manner that when the gripping handle 32 is received in the receiving chamber 413, a mid-portion of the side biasing wall 321 is faced towards the arch wall 414.

Figure 3:
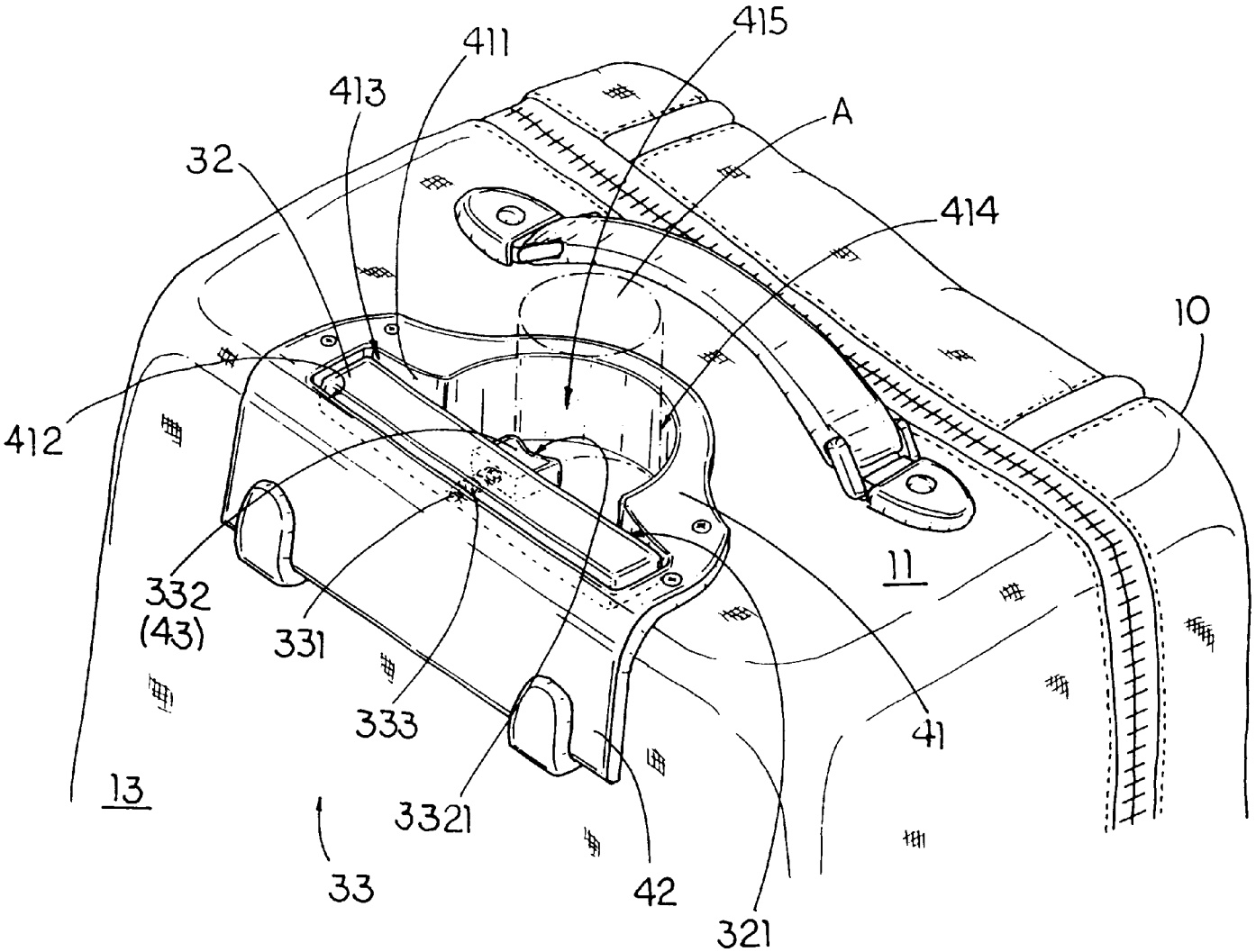
FIG. 3 is a perspective view of a holding arrangement of the carrying container according to the above preferred embodiment of the present invention, illustrating a smaller size of a holding object being held by the holding arrangement.

As shown in FIG. 3, when the bottom portion of the holding object A is received in the holding cavity 415, the circumferential surface of the holding object A is surrounded by the arch wall 414 and the side biasing wall 321 of the gripping handle 321 so as to securely hold the bottom portion of the holding object A on the top side 11 of the container body 10.

As shown in FIG. 3, the arch wall 414, having a predetermined height, is downwardly extended from a top side of the handle seat 41 for substantially increasing a contact area between the arch wall 414 of the holding cavity 415 and a circumferential surface of the holding object A when the bottom portion of the holding object A is disposed in the holding cavity 415 so as to ensure the bottom portion of the holding object A is held within the holding cavity 415 in position.

Figure 4:
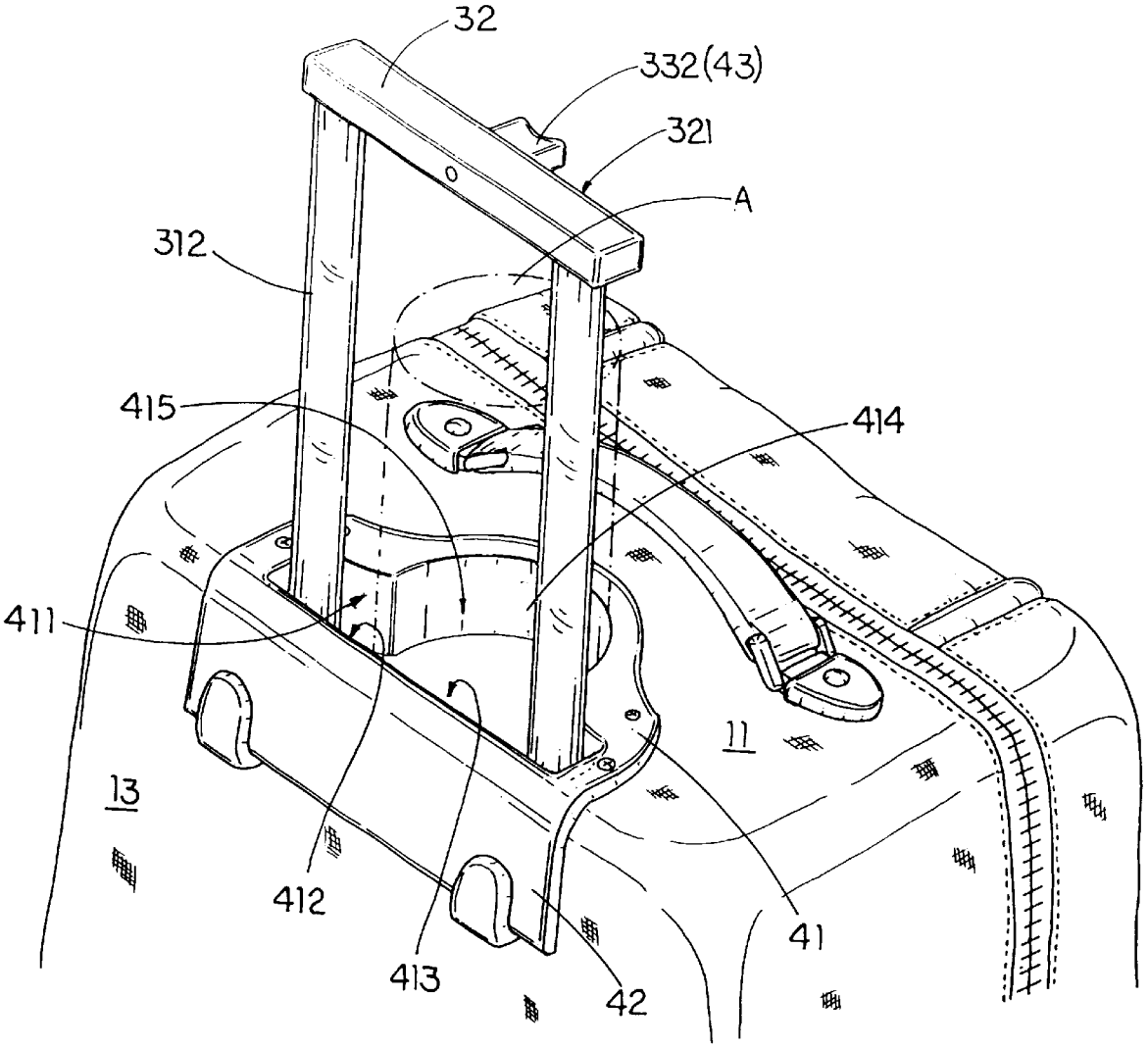
FIG. 4 is a perspective view of the holding arrangement of the carrying container according to the above preferred embodiment of the present invention, illustrating a bigger size of a holding object being held by the holding arrangement.

When the bottom portion of the holding object A has a bigger size that does not fit between the arch wall 414 and the side biasing wall 321 of the gripping handle 32, the gripping handle 32 is capable of upwardly extending from the upper side 11 of the container 10 to maximize the receiving chamber 413, such that when the holding object A is disposed in the holding cavity 415, the circumferential surface portion of the holding object A is biased against the arch wall 414 while the opposed circumferential surface portion of the holding object A is biased against the second inner wall 412 of the receiving chamber 413, as shown in FIG. 4. In other words, the size of the receiving chamber 413 can be selectively adjusted by folding the gripping handle 32 in order to hold any size of the bottom portion of the holding object A in position.

The holding arrangement 40 further comprises means 43 for retaining the bottom portion of the holding object A within the holding cavity 415.

As shown in FIG. 3, the extensible handle system 30 further comprises a locking unit 33 which comprises means 331 for locking the gripping handle 32 within the receiving chamber 413, an actuation button 332 movably mounted on the side biasing wall 321 of the gripping handle 32, and a resilient element 333 provided between the gripping handle 32 and the actuation button 332 for applying an urging pressure against the actuation button 332 towards the arch wall 414 and retaining the gripping handle 32 in a locked position. In which, at the locked position, a gripping handle 32 is locked within the receiving chamber.413, and at an unlocked position, the actuation button 332 is pressed into the gripping handle 32 to release the locking means 331, so that the gripping handle 32 is allowed to slide upwardly with respect to the retractable handle assembly 31.

The locking means 331 is arranged to lock up the sliding movement of the gripping handle 32 by locking up the gripping handle 32 to the second inner wall 412 of the handle seat 41 in such a manner that when the gripping handle 32 is downwardly slid into the receiving chamber 413, the gripping handle 32 is locked up with respect to the second inner wall 412 of the handle seat 41, so as to lock up the gripping handle 32 in the folded position. However, the locking means 331 can be simply modified by someone who skills in the art to lock up the extensible arm 312 with respect to the base support 311.

The actuation button 332 is movably provided on the side biasing wall 321 of the gripping handle 32 through a slider slot provided thereon and arranged in such a manner that the actuation button 332 is pressed into the gripping handle 32 for release the lock up manner of the gripping handle 32.

The resilient element 333, according to the preferred embodiment, is a compression spring having two ends biasing against the actuation button 332 and the gripping handle 32 respectively so as to outwardly push the actuation button 332 towards the holding cavity 415.

Accordingly, the retaining means 43 is embodied as the actuation button 332 that when the holding object A is disposed in the holding cavity 415, the actuation button 332 is pushed to bias against the bottom portion of the holding object A so as to securely hold the holding object A in position. In other words, the actuation button 332 is capable of pushing the holding object A at a position that the circumferential surface of the bottom portion of the holding object A is biased against the arch wall 414, as shown in FIG. 3.

Preferably, the actuation button 332 is shaped to form a concave biasing surface 3321 arranged for biasing against the circumferential surface of the bottom portion of the holding object A. The concave biasing surface 3321 of the actuation button 332 is capable of substantially enlarging a contact area between the actuation button 332 and the holding object A so as to enhance the holding manner of the actuation button 332. Moreover, the concave biasing surface 3321 of the actuation button 332 is advantage in practice since the concave biasing surface 3321 of the actuation button 332 is shaped to fit the finger of the traveler to press thereon in order to unlock the gripping handle 32.

Figure 5:
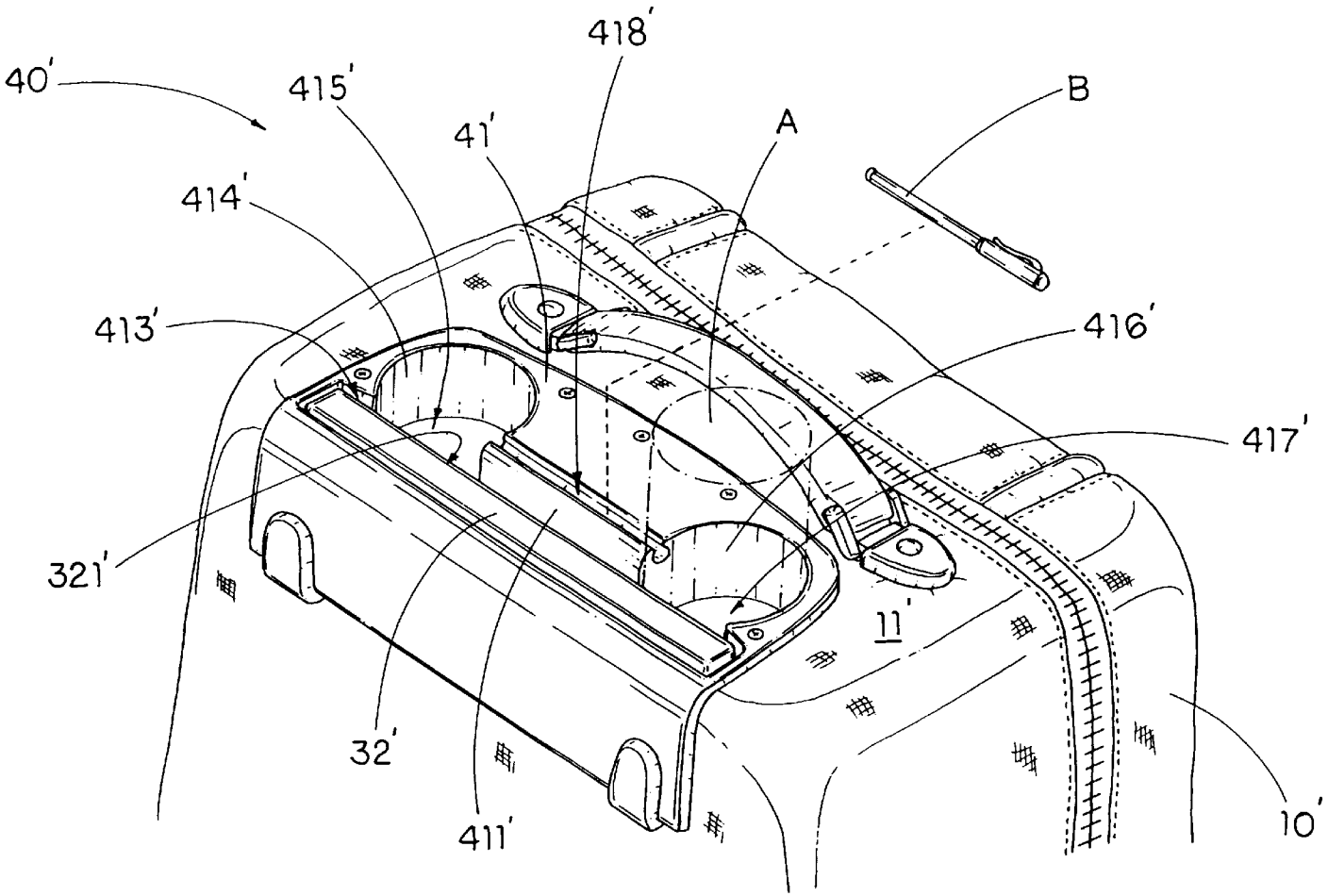
FIG. 5 illustrates an alternative mode of a holding arrangement of the carrying container according to the above preferred embodiment of the present invention.

FIG. 5 illustrates an alternative mode of the holding arrangement 32' of the carrying container. The handle seat 41' further contains a second arch wall 416 integrally extended from the first inner wall 411' to form a second holding cavity 417' wherein the first and second arch walls 414', 416' are integrally extended from the two end portions of the first inner wall 411' in such a manner that the first and second holding cavities 415', 417' are communicated with the receiving chamber 413' at two side portions thereof. Therefore, two holding objects A can be held in the holding cavities 415', 417' in position respectively, so as to securely support on the upper side 11' of the container body 10'.

When the holding object A is disposed in one of the first and second holding cavities 415', 417', the circumferential surface of the bottom portion of the holding object A is surrounded by the respective arch wall 414', 416' and the side biasing wall 321' of the gripping handle 32'.

The handle seat 41' of the holding arrangement 40' further contains an elongated holding slot 418' provided on the first inner wall 411' of the receiving chamber 413' at a position between the first and second arch walls 414', 146' for holding an elongated object B. Accordingly, the elongated object B, such as a pen, is capable of being held in the holding slot 418' in such a manner that the holding arrangement 40' functions not only as a cup holder but also as a penholder to organize the necessary tools for the traveler. Most travelers have experience that they must open the carrying container to look for the pen to fill up a form at the airport or the like. Therefore, when the holding arrangement 40' provides a penholder, the travelers can easily organize the pen without wasting time to look for the pen.

In the view of above, the present invention substantially minimizes the hassle of organizing the necessary tools for the travelers. Since the conventional must employ some kinds of connection to securely mount the extensible handle frame to the top panel of the container body, the present invention simply modify the extensible handle frame to provide the useful features for the travelers without altering the original structures of the container body and the handle frame. Therefore, the present invention successfully provides an economic and efficient solution for every carrying container having the extensible handle frame.

What is claimed is:

1. A carrying container, comprising:

a container body having an upper side and a bottom side;

a wheel assembly mounted on said bottom side of said container body;

an extensible handle system comprising a retractable handle assembly supported between said upper and bottom sides of said container body and a gripping handle slidably connected to said retractable handle assembly in vertically movable manner such that said gripping handle is capable of sliding upwardly above said upper side of said container body at an extending position and is allowed to be retracted to a folded position that said gripping handle is positioned on said upper side of said container body; and a holding arrangement, which is adapted for holding an object having a circular bottom portion in position, comprising a handle seat securely mounted on said upper side of said container body to retain a vertical movement of said gripping handle wherein said handle seat has a receiving chamber indented thereon to form a first and a second longitudinal opposed inner wall and an arch wall integrally extended from said first inner wall to form a holding cavity to communicate with said receiving chamber;

wherein said receiving chamber, having a width at least larger than a width of said gripping handle, is arranged to receive said gripping handle therein while a side biasing wall of said gripping handle faces towards said arch wall;

whereby, when said bottom portion of the object is disposed in said holding cavity, said arch wall is biased against a circumferential surface portion of the object while said side biasing wall of said gripping handle is biased against an opposed circumferential surface portion of the object so as to securely hold said holding object on said upper side of said container body.

2. A carrying container, as recited in claim 1, wherein said arch wall is integrally extended from a mid-portion of said first inner wall of said receiving chamber in such a manner that a mid-portion of said side biasing wall of said gripping handle is arranged for biasing the circumferential surface portion of the object when the bottom portion of the object is disposed in said holding cavity.

3. A carrying container, as recited in claim 2, wherein said arch wall, having a predetermined height, is downwardly extended from a top side of said handle seat for substantially increasing a contact area between said arch wall of said holding cavity and a circumferential surface of the object when the bottom portion of the object is disposed in said holding cavity.

4. A carrying container, as recited in claim 1, wherein said holding arrangement further comprises means for retaining the bottom portion of the object within said holding cavity.

5. A carrying container, as recited in claim 2, wherein said holding arrangement further comprises means for retaining the bottom portion of the object within said holding cavity.

6. A carrying container, as recited in claim 3, wherein said holding arrangement further comprises means for retaining the bottom portion of the object within said holding cavity.

7. A carrying container, as recited in claim 1, wherein said extensible handle system further comprises a locking unit which comprises means for locking said gripping handle within said receiving chamber, an actuation button movably mounted on said side biasing wall of said gripping handle, and a resilient element provided between said gripping handle and said actuation button for applying an urging pressure against said actuation button towards said arch wall, wherein said actuation button is adapted for biasing the circumferential surface portion of the object so as to push said bottom portion of the object to bias against said arch wall.

8. A carrying container, as recited in claim 2, wherein said extensible handle system further comprises a locking unit which comprises means for locking said gripping handle within said receiving chamber, an actuation button movably mounted on said side biasing wall of said gripping handle, and a resilient element provided between said gripping handle and said actuation button for applying an urging pressure against said actuation button towards said arch wall, wherein said actuation button is adapted for biasing the circumferential surface portion of the object so as to push said bottom portion of the object to bias against said arch wall.

9. A carrying container, as recited in claim 3, wherein said extensible handle system further comprises a locking unit which comprises means for locking said gripping handle within said receiving chamber, an actuation button movably mounted on said side biasing wall of said gripping handle, and a resilient element provided between said gripping handle and said actuation button for applying an urging pressure against said actuation button towards said arch wall, wherein said actuation button is adapted for biasing the circumferential surface portion of the object so as to push said bottom portion of the object to bias against said arch wall.

10. A carrying container, as recited in claim 2, wherein said holding arrangement further comprises an edge protecting panel integrally extended from said handle seat to attach on a rear side of said container body so as to protect an edge between said upper and rear sides thereof.

11. A carrying container, as recited in claim 6, wherein said holding arrangement further comprises an edge protecting panel integrally extended from said handle seat to attach on a rear side of said container body so as to protect an edge between said upper and rear sides thereof.

12. A carrying container, as recited in claim 9, wherein said holding arrangement further comprises an edge protecting panel integrally extended from said handle seat to attach on a rear side of said container body so as to protect an edge between said upper and rear sides thereof.

13. A carrying container, as recited in claim 1, wherein said handle seat further has a second arch wall integrally extended from said first inner wall to form a second holding cavity, wherein said first and second arch walls are integrally extended from said two end portions of said first inner wall in such a manner that said first and second holding cavities are communicated with said receiving chamber at two side portions thereof for holding two objects respectively.

14. A carrying container, as recited in claim 13, wherein each of said first and second arch walls, having a predetermined height, is downwardly extended from a top side of said handle seat for substantially increasing a contact area between said arch wall of said holding cavity and a circumferential surface of the object when the bottom portion of the object is disposed in said holding cavity.

15. A carrying container, as recited in claim 13, wherein said handle seat further contains an elongated holding slot provided on said first inner wall of said receiving chamber at a position between said first and second arch walls for holding an elongated object.

16. A carrying container, as recited in claim 14, wherein said handle seat further contains an elongated holding slot provided on said first inner wall of said receiving chamber at a position between said first and second arch walls for holding an elongated object.

17. A carrying container, as recited in claim 13, wherein said holding arrangement further comprises an edge protecting panel integrally extended from said handle seat to attach on a rear side of said container body so as to protect an edge between said upper and rear sides thereof.

18. A carrying container, as recited in claim 14, wherein said holding arrangement further comprises an edge protecting panel integrally extended from said handle seat to attach on a rear side of said container body so as to protect an edge between said upper and rear sides thereof.

19. A carrying container, as recited in claim 15, wherein said holding arrangement further comprises an edge protecting panel integrally extended from said handle seat to attach on a rear side of said container body so as to protect an edge between said upper and rear sides thereof.

20. A carrying container, as recited in claim 16, wherein said holding arrangement further comprises an edge protecting panel integrally extended from said handle seat to attach on a rear side of said container body so as to protect an edge between said upper and rear sides thereof.

* * * * *